US005226920A

United States Patent [19]

Andreasson

[11] Patent Number: 5,226,920

[45] Date of Patent: Jul. 13, 1993

[54] METHOD AND ARRANGEMENT FOR ADJUSTING AIR/FUEL RATIO OF AN I. C. ENGINE

[75] Inventor: Bo C. Andreasson, Kungälv, Sweden

[73] Assignee: Aktiebolaget Electrolux, Stockholm, Sweden

[21] Appl. No.: 943,294

[22] Filed: Sep. 10, 1992

[30] Foreign Application Priority Data

Sep. 11, 1991 [SE] Sweden ..... 9102631

[51] Int. Cl.[5] ..... F02D 41/04; F02D 41/26

[52] U.S. Cl. ..... 123/436; 123/438

[58] Field of Search ..... 123/333, 344, 436, 438

[56] References Cited

U.S. PATENT DOCUMENTS

| | | | |
|---|---|---|---|
| 3,548,792 | 12/1970 | Palmer et al. | 123/438 |
| 4,368,707 | 1/1983 | Leshner et al. | 123/436 |
| 4,434,768 | 3/1984 | Ninomiya | 123/436 |
| 4,442,815 | 4/1984 | Ninomiya | 123/436 |
| 4,543,934 | 10/1985 | Morita et al. | 123/436 |
| 4,617,892 | 10/1986 | Staerzl | 123/436 X |
| 4,776,312 | 10/1988 | Yoshioka et al. | 123/436 |
| 4,829,963 | 5/1989 | Oblaender et al. | 123/436 |
| 4,949,692 | 8/1990 | Devine | 123/438 X |
| 5,016,593 | 5/1991 | Takaoka | 123/436 |
| 5,018,498 | 5/1991 | Hoover | 123/436 X |

FOREIGN PATENT DOCUMENTS

| | | | |
|---|---|---|---|
| 3440 | 1/1985 | Japan | 123/436 |
| 125739 | 7/1985 | Japan | 123/436 |

*Primary Examiner*—Willis R. Wolfe

*Attorney, Agent, or Firm*—Pearne, Gordon, McCoy & Granger

[57] ABSTRACT

For adjusting the air/fuel ratio (A/F) of an i. c. engine having an electrically adjustable carburetor, an electronic detector and control unit is used to which current is supplied by an ignition magnet or generator and which comprises a tachometer, data processing means, an electronic memory, and a control unit for adjusting said ratio. The first derivative of the speed of revolution of the engine is used as a parameter for the adjustment. According to the invention, the adjustment is made after a period of time during which the speed of the engine has been generally constant. Generally constant speed is detected by calculating the average value of said derivative, such that the speed of revolution of the engine is considered to be generally constant when said average value is approximately zero.

4 Claims, 3 Drawing Sheets

METHOD AND ARRANGEMENT FOR ADJUSTING AIR/FUEL RATIO OF AN I. C. ENGINE

Figure 1:
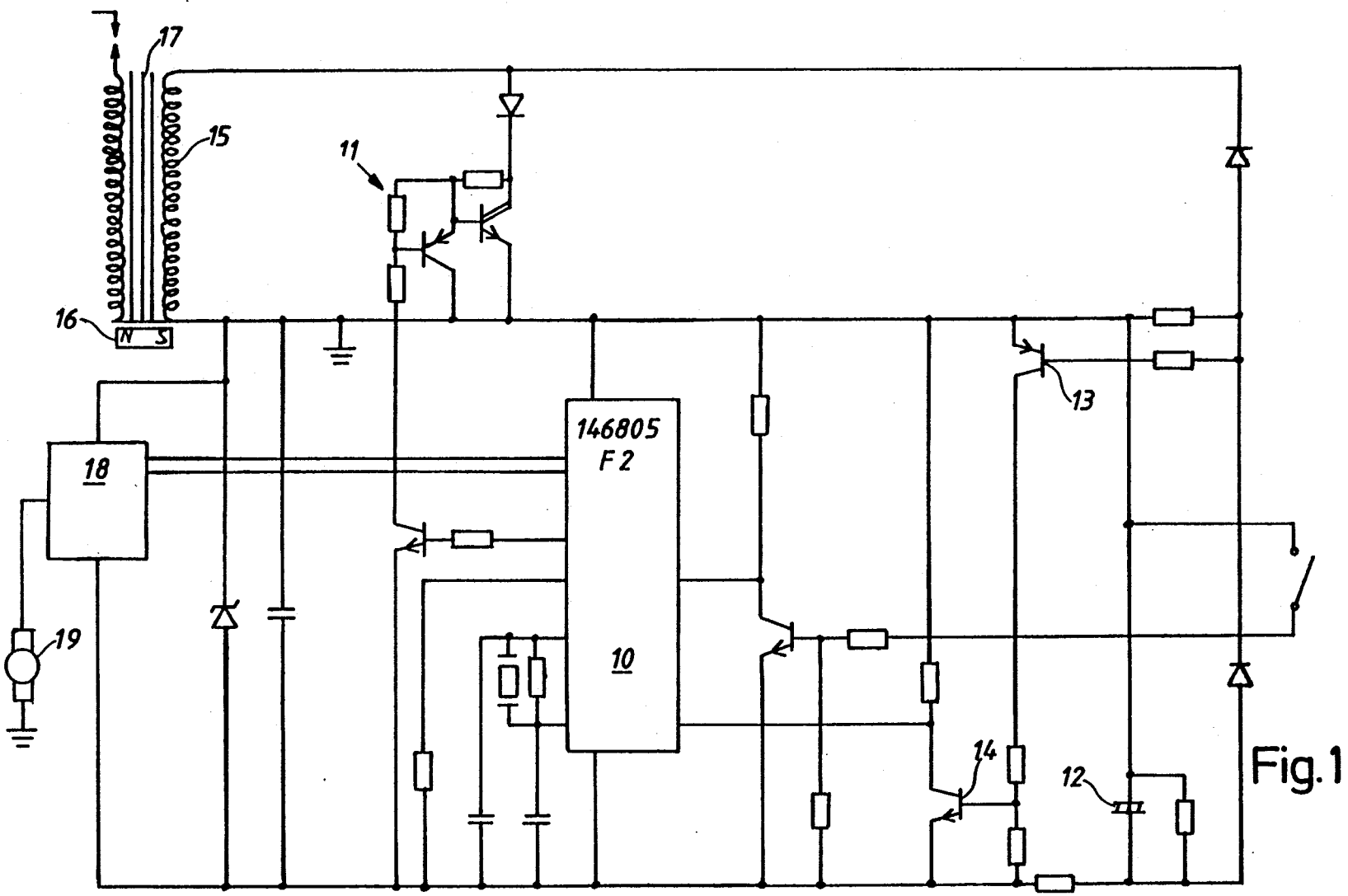

The present invention relates to a method of adjusting the air/fuel ratio (A/F) of an i. c. engine provided with an electrically adjustable carburetor or fuel system, by means of an electronic detector and control unit to which current is supplied by an ignition magnet or generator and which comprises a tachometer, data processing means, an electronic memory, and a control unit for adjusting said ratio, the first derivative of the speed of revolution being used as a parameter for the adjustment.

The invention also relates to an arrangement for performing the method in an i. c. engine having a fuel system adjusted to an optimal lean air/fuel mixture in order to keep the exhaust gas emissions, primarily HC and CO, at a low level.

I. c. engines produce undesirable exhaust gases the composition of which is influenced by the air/fuel ratio of the engine. According to the technique used at present for adjusting the carburetor, the operator adjusts the carburetor manually at full gas to obtain a recommended maximum speed of rotation. Due to the instability of membrane carburetors used at present such adjustment must be carried out a plurality of times daily. This technique is unsatisfactory to meet new demands since it does not ensure in any way that the contents of HC and CO are kept within prescribed limits. New technique is therefore necessary. In products such as chain saws, lawn mowers, clearing saws, etc. the manufacturing cost is very essential due to the low price of the products. In products of this type a magnetic ignition system without a generator is normally used.

The present invention makes it possible to combine the calibration electronics with the electronics of the ignition system in order to minimize cost. By using a portion of the energy of the ignition magnet for feeding current to the electronic equipment no extra generator or battery is required. The complete system comprises:

Electronic unit for detection and control.

Adjusting means in the carburetor (fuel system) controlled by the electronic equipment and enabling control of the amount of fuel.

Magnetic ignition system in which the current pulse induced by the magnet is used as current supply and sensor of the speed of rotation. Full gas sensor (optional).

The invention is directed to a method of detection and adjustment inherent in the control electronics. It is previously known to detect small variations of the speed from one revolution to another by means of electronic means connected to a magnetic ignition system in which the signal generated by the ignition magnet in the primary or charging winding is used for measuring the speed of the engine by measuring the period of time between pulses. This method is very accurate in that even small variations of speed can be detected and it also provides a rapid response. The method is previously known from Swedish Patent No. 8403280-4.

The invention makes it possible to use this technique for detecting when the air/fuel mixture is too lean, so that the engines is running irregularly. The method according to the invention is generally characterized in that the adjustment is performed after a period of time during which the speed of the engine has been generally constant, and that generally constant speed is detected by calculating the average value of said derivative, such that the speed of revolution of the engine is considered to be generally constant when said average value is approximately zero.

Figure 2:
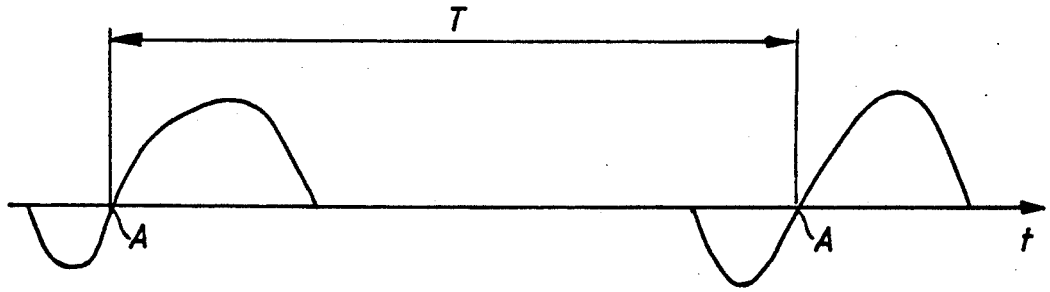
Figure 3:
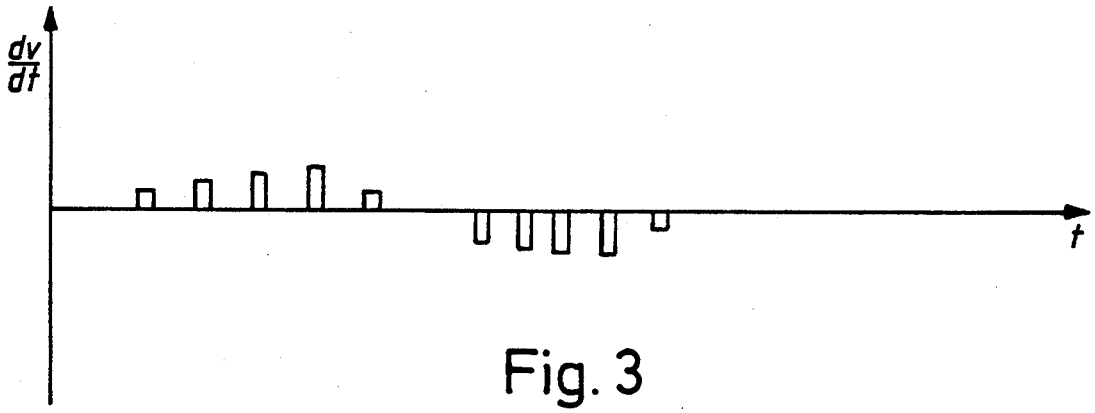
Figure 4:
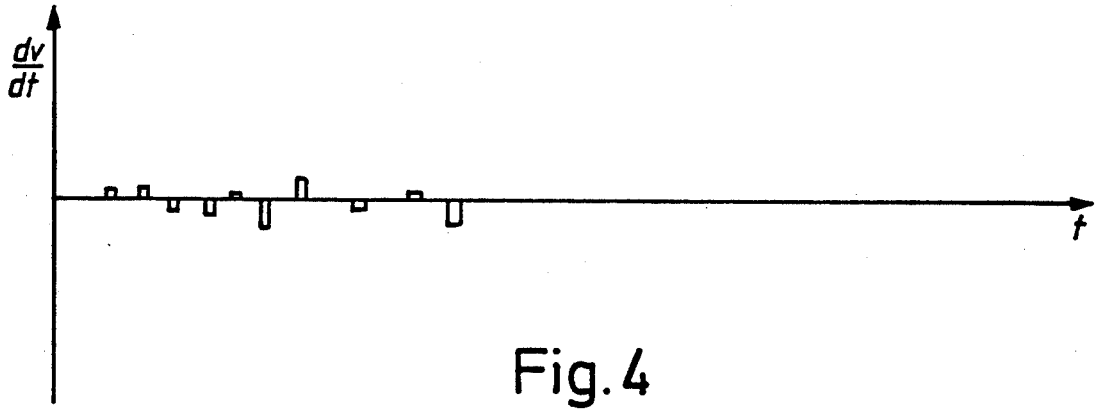
Figure 5:
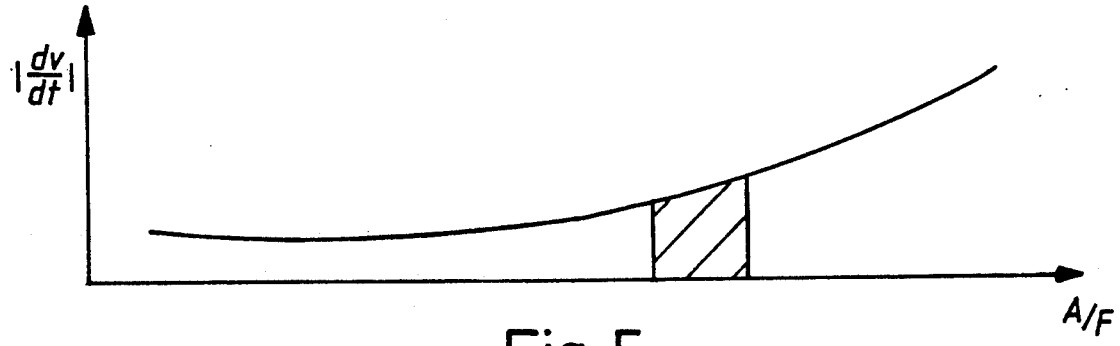
Figure 6:
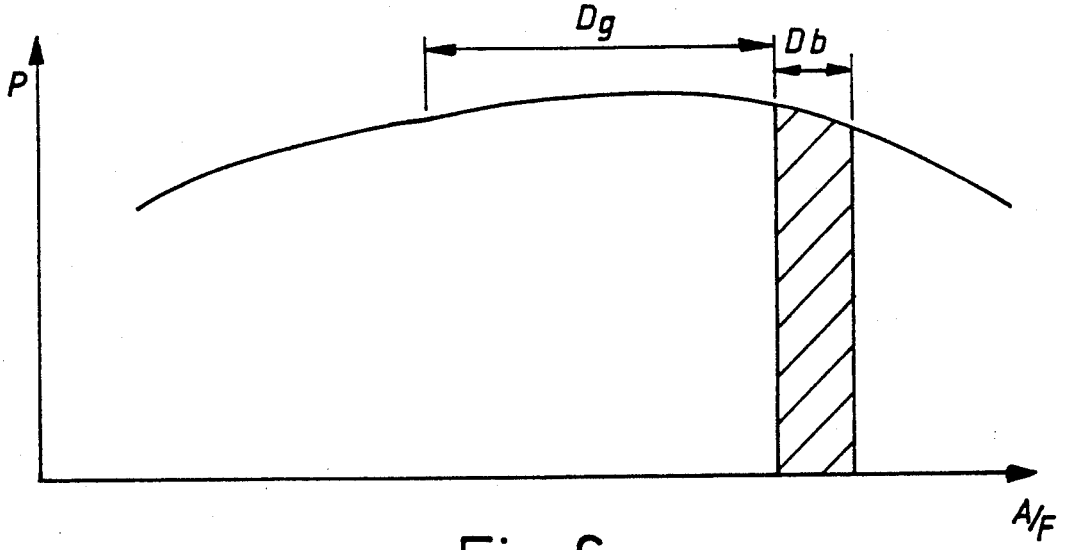
Figure 7:
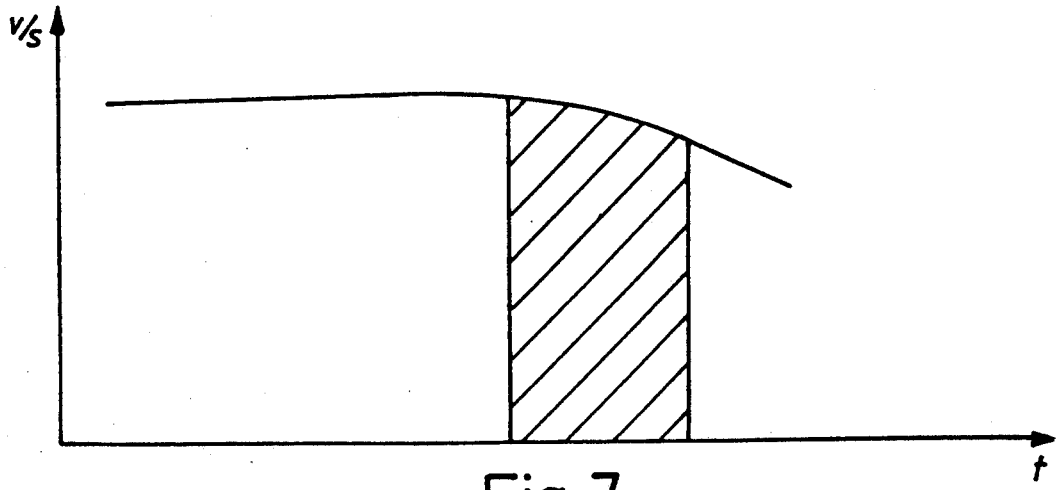

The invention will be described in more detail below in the form of an example and with reference to the accompanying drawings, in which FIG. 1 is a wiring-diagram of the arrangement, FIG. 2 shows a graph of the primarily induced voltage in the ignition coil, FIG. 3 is a diagram of a first derivative of the speed function, FIG. 4 is a diagram of a further derivative (enlarged), FIG. 5 is a diagram of an average derivative as a function of A/F, FIG. 6 is a diagram of the engine power as a function of A/F, and FIG. 7 is a diagram of the engine speed as a function of time.

The wiring-diagram of the arrangement shown in FIG. 1 comprises a micro-computer 10. The supply of current to the electronic circuits and the computer takes place by means of negative half periods of the primary voltage of an ignition generator 11 which maintains a condenser 12 charged to operation voltage. A transistor amplifier 13, 14 is used to feed pulses at the time A of the reference point of the voltage graph (FIG. 2) and in this case said point occurs 0.6 V before the zero crossing of the upward portion of the graph. The pulse is supplied to the micro-computer as a starting signal for a procedure which will be described schematically.

The inlet at which the signal is entered is read, and the time point A is stored as a reference point. Such storing is made possible in that the micro-computer has a timer operating at a fixed frequency. At each reference point the number of pulses from the previous reference point (distance A-A) is read, said number of pulses corresponding to 360 degrees of revolution. By dividing the number of pulses by a fixed figure, for example 16, a number of pulses is obtained which corresponds to an ignition angle of 360/16=22,5°. This number is designated reference number and constitutes a memory factor in the static memory of the computer. The reference number may be dependent on the speed of revolution and is inversely proportional at low speed (straight horizontal line). When the number of timer pulses reaches said reference number (the comparison is made in an AND-circuit) ignition is initiated via an outlet of the computer. The timer is set to zero each time a reference point occurs, and a count-up to the reference number is made before each spark.

FIG. 2 illustrates the voltage primarily induced in the primary winding 15 of an ignition coil when a permanent magnet 16 of a flywheel passes the iron core 17 of the coil. The trigging point A is used for time measurement, and the time period T between two trigging points is used for measuring the speed and calculating the first derivative of the speed function. The engine speed is 1/T and the first derivative is obtained by subtracting two subsequent values of the engine speed.

FIG. 3 shows the first derivative when the engine is accelerating or decelerating. Each staple shows a calculated value occurring at each revolution of the engine. The derivative is positive during acceleration and negative during deceleration. When the speed is constant the average value of the first derivative is zero. However, the derivative varies slightly due to the small variations of speed caused by irregularities of the combustion. In FIG. 4 such irregularities are shown, but the average value is approximately zero.

In order to study the dependency of the derivative on the air/fuel ratio A/F of the combustion gas of the engine, the best illustration is provided by a graph showing the average value of the absolute value of the first derivative, as in FIG. 5. The graph shows that the absolute value of the derivative increases with lean air/fuel mixture, and to minimize the contents of CO of the exhaust gases an area is selected (hatched in the figure) in which this content is about 1-1.5% and the operational data of the engine are determined thereby.

FIG. 6 illustrates the variation of the engine power P in relation to the mixture ratio A/F. The power decreases both with too rich and too lean mixture but most with lean mixture. If the mixture is made leaner when the engine is operating at a constant load, the speed of revolution will decrease. FIG. 7 shows the speed of revolution when the parameter A/F is varied as in FIG. 6. The control area (hatched) is just at the position at which the speed begins to decrease. The adjustment is carried out by means of the micro-computer 10 which controls drive circuits 18 of an electric motor 19 connected to the fuel nozzle of the carburetor of the engine, whereby various adjustments can be made thereof by means of the computer.

A method of adjusting the carburetor to the mentioned area of delimited emissions is described in the following. The calibration starts when the engine speed has been constant during about 0.5 second and when the speed is within the limits of normal speed of operation. In a chain saw, for example, this is 7000–11000 rpm. The definition of constant speed may be that the variation of the speed of revolution must not exceed e.g. 200 rpm during 0.5 second, or that the average value of the first derivative must not exceed a permitted absolute value during 0.5 second. This period of time corresponds to 75 revolutions of the engine at 9000 rpm which is quite enough for obtaining a reliable value.

When the calibration has started the discrete absolute values of the first derivative are measured during e.g. 25 revolutions. Of these values an average value $D_{m1}$ is formed which is used as a reference (FIG. 5). If $D_{m1}$ exceeds a reference value $D_b$ measured in the laboratory, the air/fuel mixture is too lean. The air/fuel mixture is then adjusted richer in steps of about 4% until the average value of the first derivative is close to $D_b$.

In the next step, the air/fuel mixture is adjusted slightly richer, e.g. 4%. An average value $D_{m2}$ of the absolute value of the first derivative is calculated again during 25 revolutions. This average value is compared to the reference average value and to a basic reference value $D_g$ previously measured in the laboratory. If the value $D_{m2}$ is close to $D_{m1}$ this is an indication that the air/fuel ratio can be adjusted leaner, since the enrichment of the fuel did not result in any significant change. Additional certainty is obtained by comparing $D_{m2}$ and $D_{m1}$ with $D_g$. Contrary, if $D_{m2}$ is significantly below $D_{m1}$ it is an indication that the engine is already adjusted to lean fuel. $D_{m1}$ may then be compared to the reference value $D_b$ measured in the laboratory. If $D_{m1}$ is close to $D_b$ the calibration is discontinued and the air/fuel mixture is set back to the previous adjustment $D_{m1}$. Contrary, if it is possible to adjust the air/fuel ratio leaner, the calibration continues.

When the calibration is continued, the air/fuel ratio is set about 4% leaner than the initial adjustment $D_{m1}$. An average value $D_{m3}$ of the absolute value of the first derivative is again calculated. If $D_{m3}$ is higher than $D_{m1}$ the engine is operating at the flank at which lean adjustment of the air/fuel ratio actuates the degree of divergence of the engine. $D_{m3}$ is also compared to $D_b$. If these values are close to each other, the calibration is completed. If $D_{m3}$ is lower, the calibration continues in the same way in steps until the value is close to the reference value.

It should be clear that the method comprises a number of steps which can be introduced in the computer as illustrated in FIG. 1. Naturally, modifications can be made in the programme, and a similar computer can be used.

I claim:

1. Method of adjusting the air/fuel ratio (A/F) of an i. c. engine provided with an electrically adjustable carburetor or fuel system, by means of an electronic detector and control unit to which current is supplied by an ignition magnet or generator and which comprises a tachometer, data processing means, an electronic memory, and a control unit for adjusting said ratio, the first derivative of the speed of revolution being used as a parameter for the adjustment, characterized in that the adjustment is performed after a period of time during which the speed of the engine has been generally constant, and that generally constant speed is detected by calculating the average value of said derivative, such that the speed of revolution of the engine is considered to be generally constant when said average value is approximately zero.

2. Method according to claim 1, characterized in that the air/fuel ratio is adjusted stepwise or successively when the engine is operating under load, until said first derivative (speed variations) has reached a predetermined level, or a break point of lean adjustment is detected.

3. Method according to claim 1, characterized in that the air/fuel ratio is adjusted stepwise or successively when the engine is operating under load, until the limit of lean adjustment has been determined as a function of a reduction of the speed of revolution of the engine.

4. Arrangement for performing the method according to claim 1, comprising an electronic detector and control unit, tachometer, data processing means, and control unit for adjusting the fuel amount in the carburetor, characterized by a circuit for calculating the first derivative of the speed of revolution of the engine, and a memory storing information of the latest correct adjustment even when the engine is shut off.

* * * * *